US006978760B2

(12) United States Patent
Stewart et al.

(10) Patent No.: US 6,978,760 B2
(45) Date of Patent: Dec. 27, 2005

(54) MIXED MODE FUEL INJECTOR AND INJECTION SYSTEM

(75) Inventors: Chris Lee Stewart, Normal, IL (US); Ye Tian, Bloomington, IL (US); Lifeng Wang, Normal, IL (US); Scott F. Shafer, Morton, IL (US)

(73) Assignee: Caterpillar Inc, Peoria, IL (US)

( * ) Notice: Subject to any disclaimer, the term of this patent is extended or adjusted under 35 U.S.C. 154(b) by 78 days.

(21) Appl. No.: 10/601,451

(22) Filed: Jun. 23, 2003

(65) Prior Publication Data

US 2005/0098144 A1 May 12, 2005

Related U.S. Application Data

(60) Provisional application No. 60/413,537, filed on Sep. 25, 2002.

(51) Int. Cl.[7] ..... F02B 3/00
(52) U.S. Cl. ..... 123/299; 123/305
(58) Field of Search ..... 123/299, 305, 123/456, 467; 239/96, 533.2, 533.3, 533.4, 239/533.12

(56) References Cited

U.S. PATENT DOCUMENTS 4,202,500 A 5/1980 Keiczek
4,984,738 A 1/1991 Winquist
5,669,334 A 9/1997 Schonfeld et al.
5,899,389 A 5/1999 Pataki et al.
6,220,528 B1 4/2001 Cooke et al.
6,340,121 B1 1/2002 Lambert
6,378,503 B1 4/2002 Lambert
6,422,199 B1 7/2002 Buckley et al.
6,725,838 B2 * 4/2004 Shafer et al. ..... 123/446
6,769,635 B2 * 8/2004 Stewart et al. ..... 239/558

FOREIGN PATENT DOCUMENTS

DE 198 34 867 A1 2/1999
EP 1 041 272 A2 10/2000

* cited by examiner

*Primary Examiner*—Mahmoud Gimie

(74) *Attorney, Agent, or Firm*—Liell & McNeil

(57) ABSTRACT

A fuel injector includes a homogenous charge nozzle outlet set and a conventional nozzle outlet set that are controlled respectively by first and second three way needle control valves. Each fuel injector includes first and second concentric needle valve members. One of the needle valve members moves to an open position for a homogenous charge injection event, while the other needle valve member moves to an open position for a conventional injection event. The fuel injector has the ability to operate in a homogenous charge mode with a homogenous charge spray pattern, a conventional mode with a conventional spray pattern or a mixed mode.

20 Claims, 8 Drawing Sheets

MPa
100
105

101
106

MPa

MPa
102
107

L/min

MIXED MODE FUEL INJECTOR AND INJECTION SYSTEM

RELATION TO OTHER PATENT APPLICATION

This application claims the benefit of provisional application Ser. No. 60/413,537, filed Sep. 25, 2002.

GOVERNMENT RIGHTS

This invention was made with US Government support under DE-FC 05-970R22605 awarded by the Department of Energy. The government has certain rights in this invention.

TECHNICAL FIELD

The present invention relates generally to dual mode fuel injection systems, and more particularly to a fuel injector with independently controllable concentric needle valve members.

BACKGROUND

Over the years, engineers have been challenged to devise a number of different strategies toward the goal of a cleaner burning engine. Experience has taught that various injection timings, quantities and rates have a variety of different desirable results over the complete operating range of a given engine. Therefore, fuel injection systems with a variety of different capabilities can generally outperform fuel injection systems with narrower capability ranges, at least in their ability to reduce undesirable emissions. For instance, the leap from cam control to electronic control in fuel injection systems has permitted substantially lower emissions in several categories, including but not limited to $NO_x$, hydrocarbons and smoke.

One area that appears to show promise in reducing undesirable emissions is often referred to as homogenous charge compression ignition (HCCI). In an HCCI engine, fuel is injected early in the compression cycle to permit thorough mixing with cylinder air, to ideally form a lean homogeneously mixed charge before conditions in the cylinder cause auto-ignition. Engines operating in an HCCI mode have shown relatively low outputs of undesirable emissions. Although an HCCI strategy appears promising, it has its own problems. For instance, HCCI can cause extremely high cylinder pressure rise rates and force loads, rendering it most desirable at the lower half of the engine's operating range. Many are also seeking ways to address the difficulty in controlling ignition timing in engines operating with an HCCI strategy. Thus, at this time, a pure HCCI strategy is not viable for most commercial engine applications with conventional power density requirements.

This limitation of HCCI engines has been addressed in the art by equipping an engine with an HCCI fuel injection system and a conventional fuel injection system. For instance, such a dual system is shown in U.S. Pat. No. 5,875,743 to Dickey. Although such a dual system strategy appears viable, the high expense and complexity brought by two complete injection systems renders it commercially challenged. A single fuel injector is generally not compatible with performing both HCCI and conventional injections because different spray patterns are often desirable and sometimes necessitated. Providing a structure in a single fuel injector that is capable of injecting fuel in two different spray patterns, while maintaining the ability to mass produce the fuel injector and retain consistent results, has been problematic and elusive.

The present invention is directed to one or more of the problems set forth above.

SUMMARY OF THE INVENTION

In one aspect, a method of injecting fuel includes a step of injecting fuel in a first spray pattern. This is accomplished at least in part by energizing one of a plurality of actuators, relieving fuel pressure in a first needle control chamber and moving a first needle valve member in a direction with respect to a second needle valve member. In another step, fuel is injected in a second spray pattern. This is accomplished at least in part by energizing a different one of the plurality of electrical actuators, relieving fuel pressure in a second needle control chamber and moving a second needle valve member in the direction within, and with respect to, the first needle valve member.

In another aspect, a fuel injector includes an injector body that defines a first nozzle outlet set and a second nozzle outlet set that correspond to a first spray pattern and a second spray pattern respectively. First and second needle valve members are at least partially positioned in the injector body. First and second electrical actuators are operably coupled to the first and second needle valve members, respectively. One of the first needle valve member and the second needle valve member is at least partially positioned in the other of the first needle valve member and the second needle valve member.

In another aspect, a fuel injection system includes at least one fuel injector fluidly connected to a common fuel rail. The fuel injector includes an injector body that defines a first nozzle outlet set and a second nozzle outlet set that correspond to a first spray pattern and a second spray pattern, respectively. Each fuel injector also includes a first needle valve member and a second needle valve member. First and second electrical actuators are operably coupled to open and close the first and second nozzle outlet sets, respectively. One of the first needle valve member and the second needle valve member is at least partially positioned in the other of the first needle valve member and second needle valve member.

DETAILED DESCRIPTION

Figure 1:
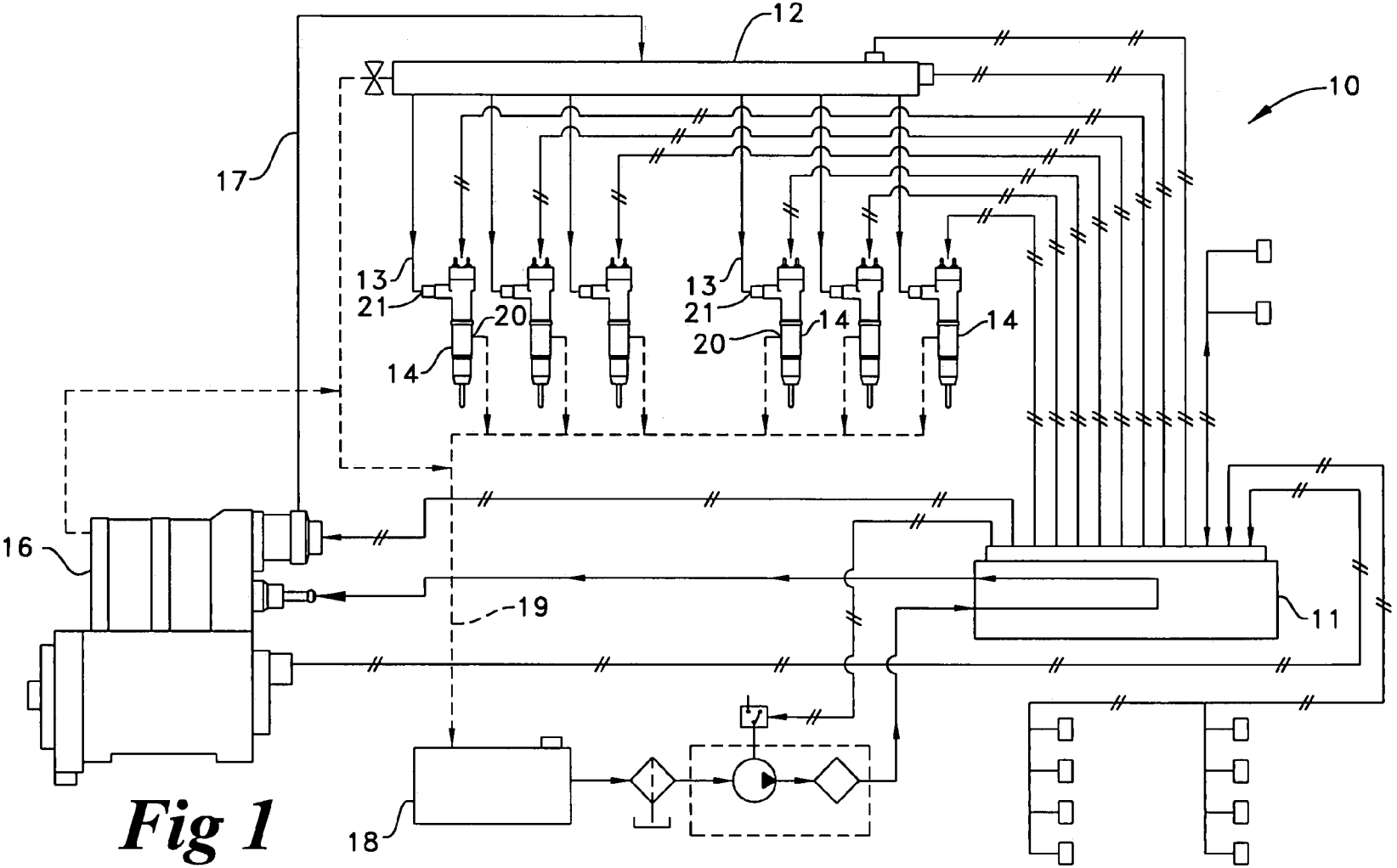
FIG. 1 is a fuel injection system according to one aspect of the present invention.

Referring to FIG. 1, a fuel injection system 10 includes a plurality of fuel injectors 14 connected to a common fuel rail 12. In the illustrated embodiment, fuel injectors 14 include tips that are appropriately located in six different cylinders of a diesel type engine. Nevertheless, those skilled in the art will appreciate that the fuel injection system of the present invention is also potentially applicable to any type of engine, including spark ignition engines. Fuel injection system 10 is controlled by an electronic control module 11 in a conventional manner. In particular, electronic control module 11 controls the output from a high pressure pump 16 to control the pressure in common fuel rail 12. In addition, electronic control module 11 controls the action of each individual fuel injector 14. The control signals for both high pressure pump 16 and fuel injectors 14 are based upon stored data and/or algorithms and/or a variety of sensor inputs known in the art.

Each fuel injector 14 includes an inlet 21 connected to the high pressure common fuel rail 12 via an individual branch passage 13. Each fuel injector 14 also includes an outlet 20 through which unused low pressure fuel is returned to fuel tank 18 via drain line(s) 19. Fuel is drawn from fuel tank 18 by a low pressure fuel circulation pump in a conventional manner. This relatively low pressure fuel is filtered and can be passed over the electronic control module 11 to cool the same before arriving at high pressure pump 16. The high pressure common fuel rail 12 includes a pressure relief valve that has the ability to return fuel to fuel tank 18 in the event that fuel pressure in common rail 12 exceeds some predetermined maximum pressure. High pressure fuel is delivered to common fuel rail 12 via a fuel supply line 17 that is connected to an outlet from high pressure pump 16.

Figure 8:
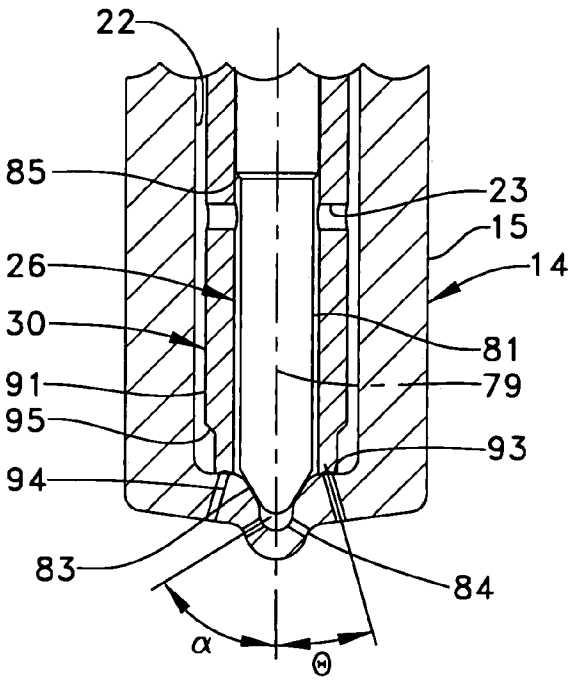
FIG. 8 is an enlarged sectioned side diagrammatic view of a tip portion of the fuel injector of FIG. 2.

Referring briefly to FIG. 8, each fuel injector 14 includes an injector body 15 that defines a conventional nozzle outlet set 84 and a homogenous charge nozzle outlet set 94 that are controlled in their opening and closing by an inner needle valve member 81 and an outer needle valve member 91, respectively. The conventional nozzle outlet set 84 is typical of those in the art and has a relatively large average angle alpha with respect to centerline 79, while homogenous charge nozzle outlet set 94 has a relatively small average angle theta with respect to centerline 79. Fuel injector 14 has the ability to inject fuel through homogenous charge nozzle outlet set 94, conventional nozzle outlet set 84, or both. Inner needle valve member 81 is a portion of a first direct control needle valve 26, while outer needle valve member 91 is a portion of a second direct control needle valve 30.

Figure 2:
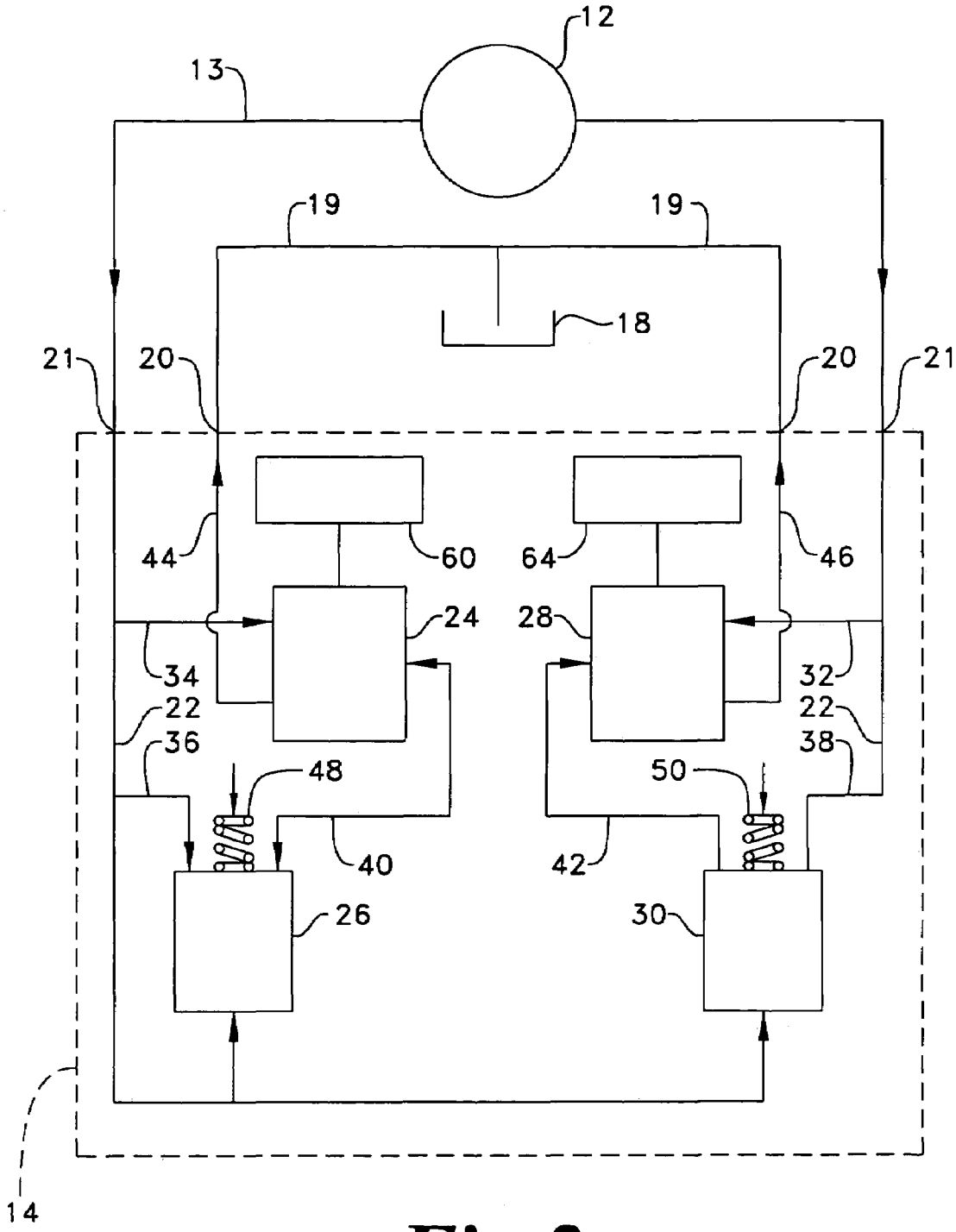
FIG. 2 is a fuel injector schematic according to another aspect of the present invention.
Figure 4:
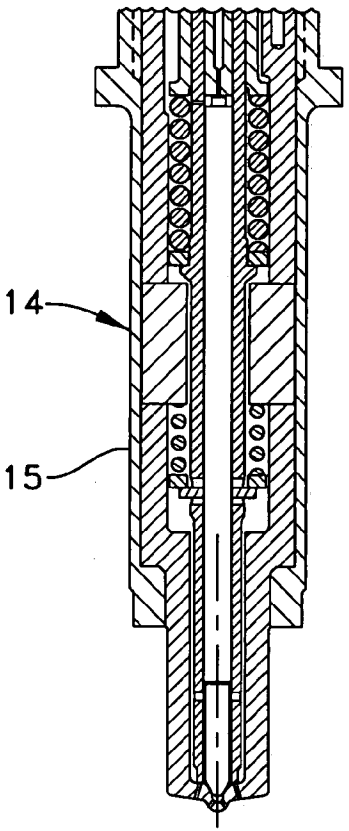
FIG. 4 is a sectioned side diagrammatic view of a lower portion of the fuel injector of FIG. 2.
Figure 3:
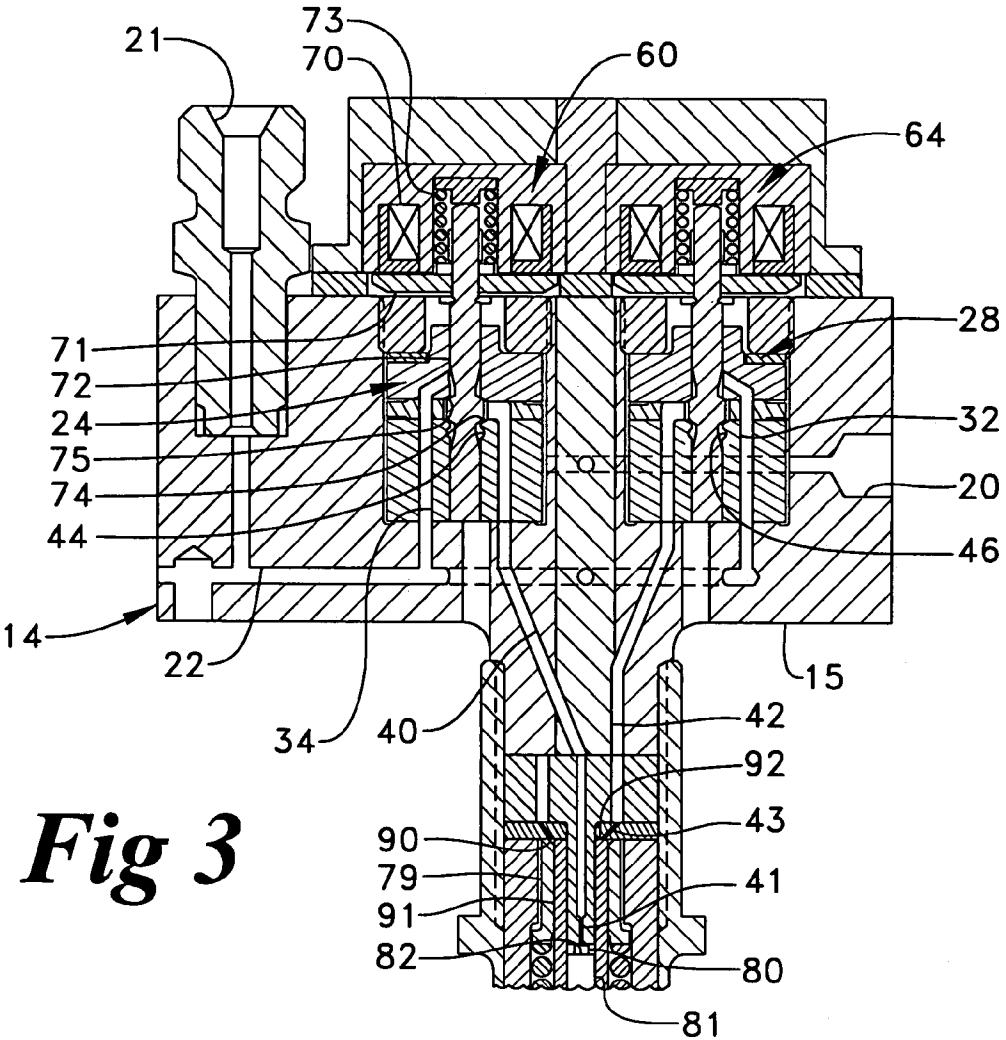
FIG. 3 is a sectioned side diagrammatic view of an upper portion of the fuel injector of FIG. 2.

Referring now to FIG. 2, the preferred internal hydraulic schematic of each fuel injector 14 is illustrated. In order to avoid too many overlapping fluid lines in the schematic illustration of FIG. 2, the fuel injector 14 is shown as including two inlets 21 and two outlets 20. Nevertheless, those skilled in the art will appreciate that in the actual constructed embodiment, each fuel injector 14 preferably includes a single inlet 21 and a single outlet 20. Thus, high pressure fuel travels to the inlet 21 of each individual injector 14 via an individual branch passage 13. Within injector 14, the high pressure fuel can reach the injector tip via a nozzle supply passage 22. This high pressure fuel is communicated to a first needle control valve 24 and a second needle control valve 28 via respective high pressure communication passages 34 and 32. Each of the needle control valves 24 and 28 is also fluidly connected via respective low pressure drain passages 44 and 46 to low pressure outlet 20, which is connected to fuel tank 18 via drain line 19 (FIG. 1). Each of the needle control valves 24 and 28 are preferably three way valves that are substantially identical in structure. However, those skilled in the art will appreciate that other valving configurations could be used.

Depending upon the position of needle control valve 24, a pressure control passage 40 is either fluidly connected to high pressure communication passage 34 or low pressure drain passage 44. Likewise, depending upon the positioning of needle control valve 28, a pressure control passage 42 is either fluidly connected to high pressure communication passage 32 or low pressure drain passage 46. In the illustrated embodiment, needle control valve 24 is biased to a position that connects pressure control passage 40 to high pressure communication passage 34, but is moveable to its other position when an electrical actuator 60, which is illustrated as a solenoid but could be another electrical actuator such as a piezo, is energized. Likewise, needle control valve 28 is preferably normally biased to a position in which pressure control passage 42 is fluidly connected to high pressure communication passage 32, but is moveable to its other position when a second electrical actuator 64 is energized. Needle control valves 24 and 28 control the positioning of direct control needle valves 26 and 30 via high or low pressure in pressure communication passages 40 and 42, respectively.

Direct control needle valve 26, which controls the opening and closing of conventional nozzle outlet set 84 (FIG. 8) is normally biased toward a closed position by a biasing spring 48. In addition, high pressure is continuously communicated to direct control needle valve 26 via an unobstructed but restricted high pressure passage 36. Thus, when pressure control passage 40 is fluidly connected to drain passage 44, direct control needle valve 26 can lift and open conventional nozzle outlet set 84. When needle control valve 24 is in its de-energized state, direct control needle valve 26 stays in, or moves toward, its closed position due to spring 48 and the high pressure communicated via high pressure passage 36 and pressure control passage 40, which at that time is connected to high pressure communication passage 34.

Outer direct control needle valve 30 operates in much a similar manner except it is controlled in its movement by needle control valve 28. Outer direct control needle valve 30 is always fluidly connected to an unobstructed but restricted high pressure passage 38, which is fluidly connected to nozzle supply passage 22. Outer direct control needle valve 30 is also biased toward its downward closed position by a biasing spring 50. When solenoid 64 is de-energized, outer direct control needle valve 30 will stay in, or move toward, its closed position due to spring 50 and the high pressure existing in both high pressure passage 38 and pressure control passage 42. When second electrical actuator 64 is energized, outer direct control needle valve 30 can move to its open position due to the connection of pressure control passage 42 to low pressure drain passage 46. Both the inner and outer direct control needle valves 26 and 30 preferably include hydraulic stops, rather than physical stops as in much of the prior art. This aspect of the direct control needle valves will be discussed more thoroughly infra, but is attributable to the unobstructed but restricted high pressure flow passages 36 and 38, respectively.

Referring now to FIGS. 3–9, the preferred inner structure of each fuel injector 14 is illustrated. As discussed earlier, each fuel injector includes an injector body 15 that defines an inlet 21, which is connected to high pressure common rail 12, and a low pressure outlet 20 that is fluidly connected to fuel tank 18. After arriving at inlet 21, the high pressure fuel enters a nozzle supply passage 22 that extends all the way through the interior of the fuel injector down to the nozzle tip. Nozzle supply passage 22 includes a connection passage 23 through outer needle valve member 91 in order to channel the high pressure fuel to the area adjacent inner needle valve member 81 and conventional nozzle outlet set 84. At some point downstream from inlet 21, a high pressure communication passage 34 connects first needle control valve 24 to nozzle supply passage 22. High pressure communication passage 34 terminates adjacent a high pressure seat 74. As stated earlier, first needle control valve 24 is also fluidly connected to low pressure outlet 20 via a drain passage 44, which is partially shown in FIG. 3. Drain passage 44 terminates adjacent a low pressure seat 75. Thus, first needle control valve 24 includes a needle control valve member 72 that is trapped to move between high pressure seat 74 and low pressure seat 75, but is biased into contact with low pressure seat 75 by a biasing spring 73. As stated earlier, a first electrical actuator 60, which in the illustrated embodiment is a solenoid, includes an armature 71 attached to needle control valve member 72. Armature 71 is positioned adjacent solenoid coil 70, which can be energized via its connection to electronic control module 11 shown in FIG. 1. When energized, needle control valve member 72 is lifted upward to close high pressure seat 74 and open low pressure seat 75. This changes the pressure in pressure control passage 40, which opens on one end into the area between high and low pressure seats 74 and 75, and opens on its other end into an inner needle control chamber 80.

Pressure control passage 40 preferably includes a flow restriction 41 that is sized to be more restrictive than a flow area past needle control valve member 72 across either high pressure seat 74 or low pressure seat 75. This strategy helps to reduce the influence of flow forces on the movement of needle control valve member 72 when moving between seats 74 and 75. This can also reduce variability from one fuel injector to the next. In other words, it is relatively difficult to tightly control the flow areas past seats 74 and 75, but it is relatively easy to make flow restriction 41 substantially uniform from one fuel injector to another. Thus, the behavior of fuel injector 14 will be somewhat desensitized to inevitable variations from one needle control valve 24 to another. In the illustrated embodiment, first electrical actuator 60 and second electrical actuator 64 are substantially identical. In addition, first needle control valve 24 is substantially identical in structure to second needle control valve 28, such that it is not necessary to repeat the description of the latter. Thus, with respect to the second needle control valve 28, it includes a pressure control passage 42 that opens on one end between high and low pressure seats adjacent the needle control valve member, and on its other end into an outer needle control chamber 90. Pressure communication passage 42 also preferably includes a flow restriction 43 that is also sized to be more restrictive than a flow area past the high and low pressure seats in order to desensitize the behavior of needle control valve 28 to inevitable variations in the flow areas past the high and low pressure seats.

Figure 6:
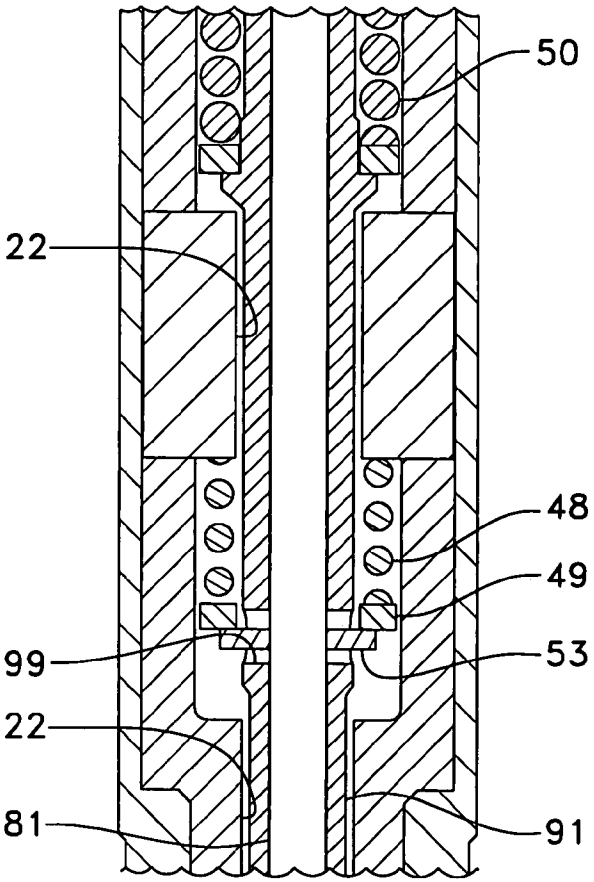
FIG. 6 is an enlarged sectioned side diagrammatic view of another middle portion of the fuel injector of FIG. 2.
Figure 5:
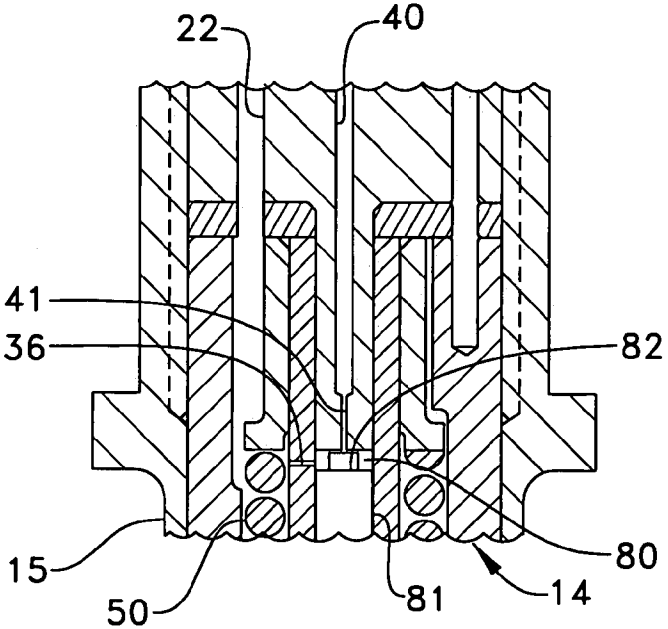
FIG. 5 is an enlarged sectioned side diagrammatic view of a middle portion of the fuel injector of FIG. 2.
Figure 9:
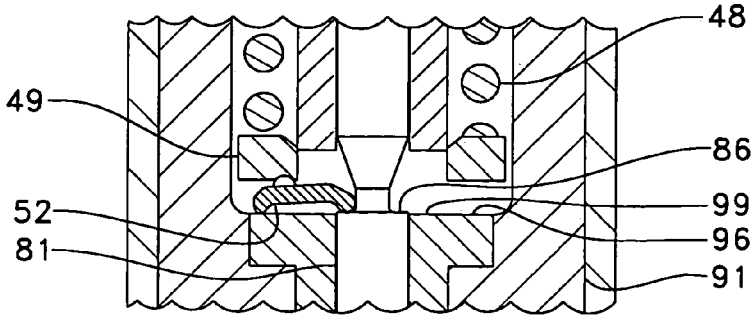
FIG. 9 is an enlarged sectioned side diagrammatic view of an alternative inner needle valve member biasing strategy according to another aspect of the present invention.

With respect to the inner needle valve member 81, which is a portion of first direct control needle valve 26, it includes a closing hydraulic surface 82 exposed to fluid pressure in inner needle control chamber 80, and an opening hydraulic surface 85 exposed to fluid pressure in nozzle supply passage 22 via connection passage 23. As best shown in FIG. 5, inner needle control chamber 80 is fluidly connected to nozzle supply passage 22 via an unobstructed but restricted high pressure passage 36, and also fluidly connected to first needle control valve 24 via pressure control passage 40. It is important to note that high pressure passage 36 is preferably more restrictive than flow restriction 41, such that fluid pressure in needle control chamber 80 drops below fluid pressure in nozzle supply passage 22 when pressure control passage 40 is connected to the low pressure drain. It is this aspect of the invention that allows inner needle valve member 81 to lift upward toward its open position when pressure control passage 40 is connected to low pressure drain due to the energization of first electrical actuator 60. Lifting of needle valve member is caused by a hydraulic force on opening hydraulic surface 85, which is exposed to fluid pressure in nozzle supply passage. Referring in addition to FIG. 6, the biasing of inner needle valve member 81 to its downward closed position via biasing spring 48 is illustrated. In this example embodiment, this is facilitated by including a pin 53 that passes through inner needle valve member 81 and through a crossbore 99 in outer needle valve member 91. Pin 53 interacts with biasing spring 48 via a spring support 49. Thus, biasing spring 48 normally biases inner needle valve member 81 downward toward a closed position in contact with valve seat 83 to close conventional nozzle outlet set 84. Referring now to FIG. 9, an alternative method of transferring the force from biasing spring 48 to the inner needle valve member 81 is illustrated. In this example embodiment, a lever 52 includes an upper portion that rests against spring support 49 and two lower portions that rest against an annular ledge 96 of outer needle valve member 91 and an annular ledge 86 of inner needle valve member 81. Thus, in the embodiment illustrated in FIG. 9, the spring force is transmitted via lever 52 to bias inner needle valve member 81 downward to close valve seat 83 as shown in FIG. 8. Preferably, there would be two or more levers 52.

Figure 7:
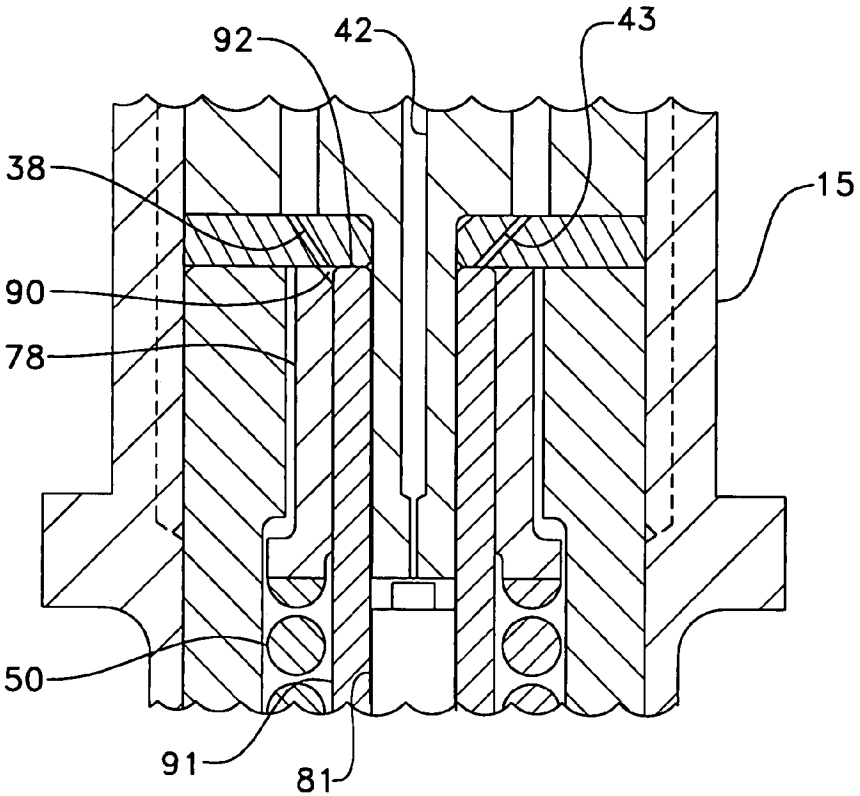
FIG. 7 is an enlarged sectioned side diagrammatic view of still another middle section of the fuel injector of FIG. 2.

Referring specifically to FIG. 7, pressure control passage 42 opens into an outer needle control chamber 90 via a flow restriction 43. In addition, outer needle control chamber 90 is fluidly connected to nozzle supply passage 22 via an unobstructed but restricted high pressure communication passage 38. As in the inner needle valve member, high pressure passage 38 is preferably more restrictive to flow than flow restriction 43 so that pressure in outer needle control chamber 90 can drop below the pressure in the nozzle supply passage 22 when pressure communication passage 42 is connected to a low pressure drain 46. The outer needle valve member 91 includes a closing hydraulic surface 92 exposed to fluid pressure in outer needle control chamber 90, and an opening hydraulic surface 95 (FIG. 8) exposed to fluid pressure in nozzle supply passage 22. A biasing spring 50 normally biases outer needle valve member 91 downward to close flat seat 93 to close fluid communication between homogenous charge nozzle outlet set 94 and nozzle supply passage 22. Biasing spring 50 also acts to bias a sealing member 78 upward to substantially close fluid communication between outer needle control chamber 90 and nozzle supply passage 22, except for the fluid connection provided by high pressure passage 38.

Figure 11B:
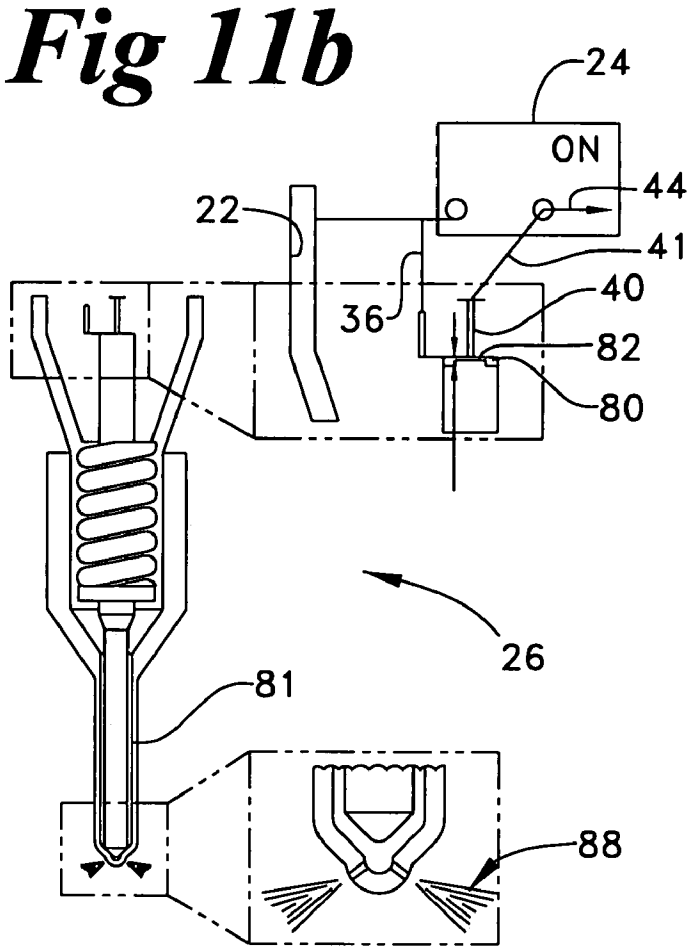
FIGS. 11*a* and 11*b* are schematic illustrations of the hydraulic stop strategy for the needle valve members of the present invention.
Figure 11A:
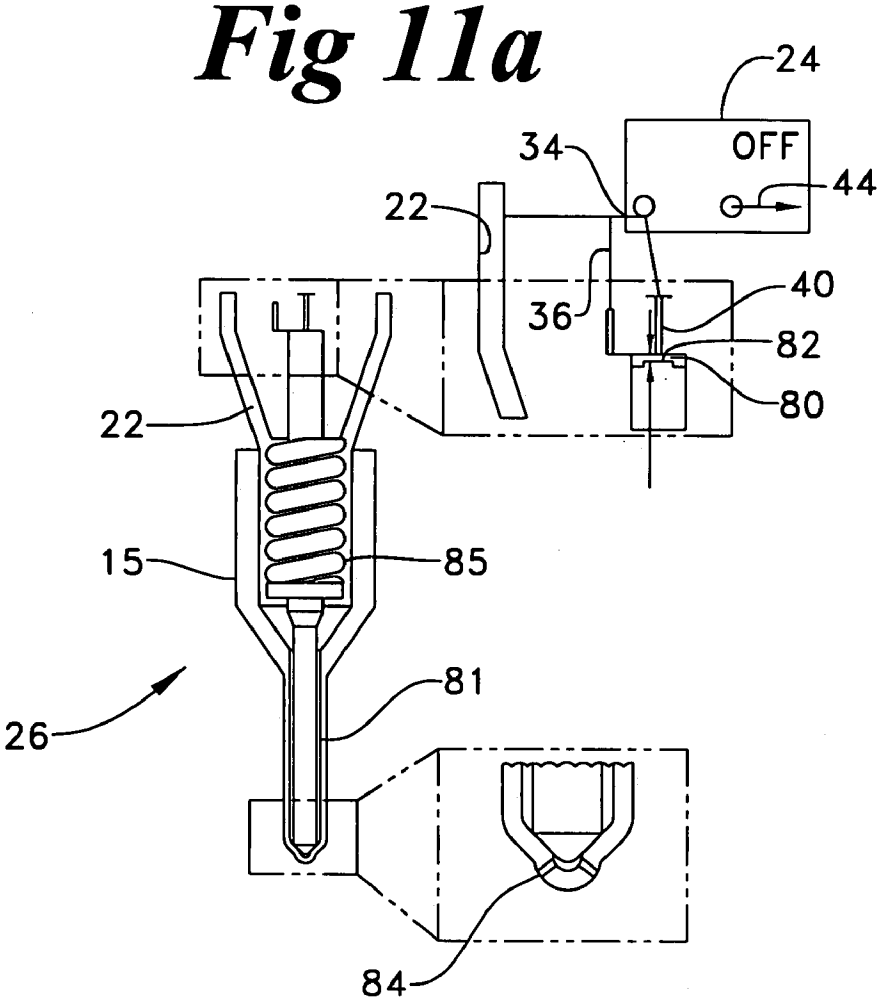

Referring now to FIGS. 11*a* and 11*b*, the hydraulic stop action of the needle valve members is illustrated schematically with respect to inner direct control needle valve 26. In particular, FIG. 11*a* shows the inner needle valve member 81 in its downward closed position to close conventional nozzle outlet set 84 due to the fact that needle control valve 24 is de-energized such that inner needle control chamber 80 is fluidly connected to nozzle supply passage 22 via high pressure passage 36 and pressure communication passage 40. When needle control valve 24 is energized as shown in FIG. 11*b*, pressure communication passage 40 becomes connected to low pressure drain via drain passage 44. This causes fluid pressure in needle control chamber 80 to drop due to the fact that high pressure passage 36 is more restricted than flow restriction 41. However, the upward movement of needle valve member 81 does not go so far as to close pressure communication passage 40, but instead stops at an equilibrium position resulting in a small fluid gap between the closing hydraulic surface 82 and the surface adjacent the opening of pressure communication passage 40. Those skilled in the art will recognize that if needle valve member 81 lifts too far to close pressure communication passage 40, fluid pressure will rise in needle control chamber 80 causing the needle valve member 81 to move downward to reopen the fluid communication between pressure communication passage 40 and needle control chamber 80. Thus, needle valve member 81 has a hydraulic stop rather than a physical stop of a type common in the prior art. FIG. 11*b* is also of interest for showing a conventional spray pattern 88, which in the illustrated embodiment preferably includes six nozzle outlets distributed around the centerline to produce a cone with a relatively large average angle alpha with respect to a centerline 79, as best shown in FIG. 8. The outer needle valve member 91 also has a hydraulic stop strategy and works in a manner much similar to that illustrated in FIGS. 11*a* and 11*b*.

Figure 10:
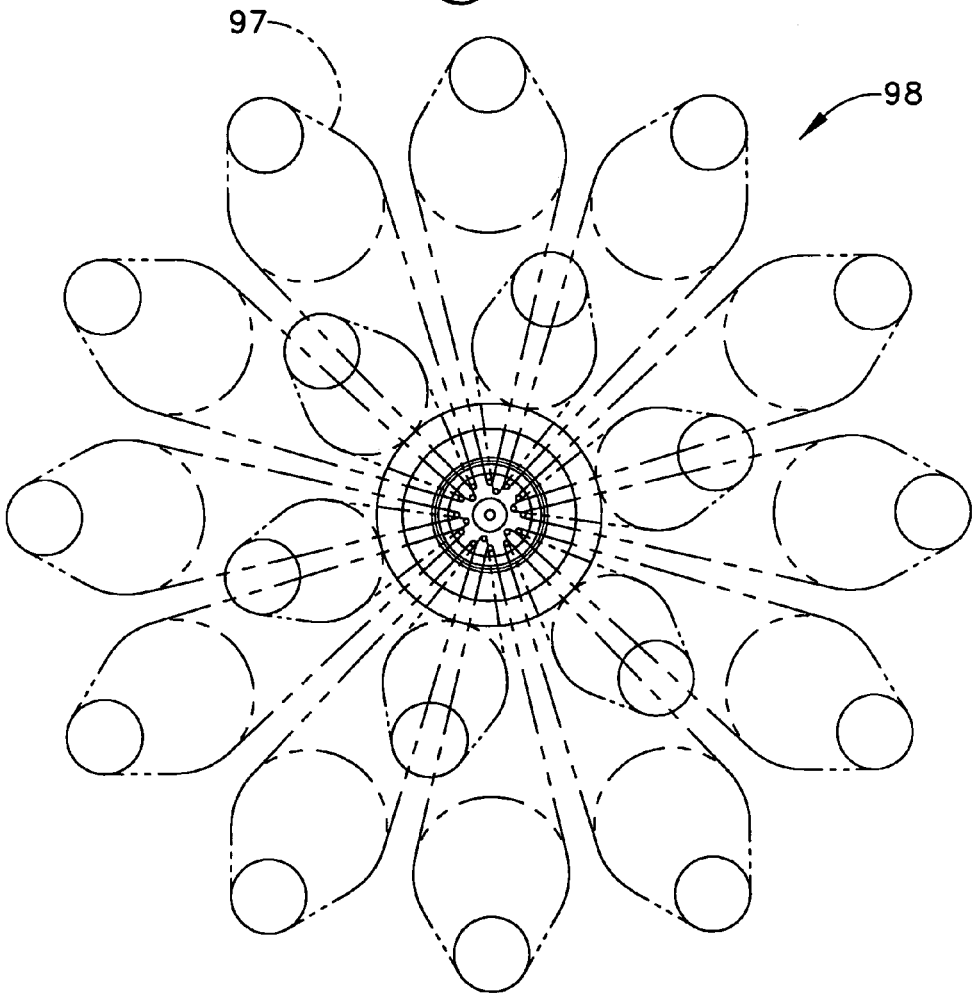
FIG. 10 is a bottom view of a homogenous charge spray pattern according to another aspect of the present invention.

Referring to FIG. 10, a preferred homogenous charge spray pattern 98 is illustrated to include 18 nonintersecting plumes 97 that are directed downward with an average angle theta, as shown in FIG. 8. Average angle theta is preferably substantially small compared to the average angle alpha of the conventional nozzle outlet set 84. The average angle theta is preferably relatively small since the homogenous charge spray preferably occurs when the engine piston is closer to a bottom dead center position than to a top dead center position such that the spray can be directed generally downward. Those skilled in the art will appreciate that the conventional spray pattern has a relatively large angle alpha because injection typically takes place when the engine piston is closer to a top dead center position, such that the fuel spray needs to be directed generally outward in order to avoid too much contact with the engine piston and/or cylinder walls. As shown in FIG. 10, the homogenous charge spray pattern preferably has a shower head design with many small holes that produce nonintersecting plumes 97. Thus, as shown in FIG. 8, the homogenous charge nozzle outlet set preferably surrounds the conventional nozzle outlet set 84 about centerline 79, but this is not a necessity. In addition, the homogenous charge nozzle outlet set 94 preferably includes more nozzle outlets than the conventional nozzle outlet set 84. Nevertheless, those skilled in the art will appreciate that this is a preference and not a necessity.

INDUSTRIAL APPLICABILITY

The fuel injection system 10 and fuel injectors 14 of the present invention are generally applicable to any internal combustion engine. However, the present invention finds particular applicability in relation to compression ignition engines in which the injector tip is partially positioned in the engine cylinder for direct injection into the combustion space. Nevertheless, those skilled in the art will appreciate that the present invention could find potential application in other engines, including but not limited to spark ignition engines. The present invention finds particular applicability to compression ignition engines because of its ability to advantageously produce two different spray patterns depending upon how the engine is being operated. For instance, under relatively low load conditions, it might be desirable to operate the engine in a pure homogenous charge fashion in which fuel is injected relatively early in the engine cycle when the engine piston is closer to a bottom dead center position than a top dead center position. As the piston continues moving upward, the fuel charge preferably thoroughly mixes with air in the cylinder to produce relatively lean homogenous mixture that spontaneously combusts when the engine piston nears its top dead center position. When the engine is being operated at relatively high speeds and loads, it might be desirable to operate the fuel injection system in a conventional mode in which fuel is sprayed into the engine cylinder in a conventional spray pattern when the engine piston is at or near its top dead center position. In between these two extremes, it might be desirable to operate the fuel injection system in a mixed mode in which some fuel is injected through the homogenous charge nozzle outlet set early in the engine cycle and then later in the engine cycle additional fuel is injected via the conventional nozzle outlet set when the engine piston is at or near its top dead center position. Fuel can also be sprayed through both nozzle outlet sets simultaneously, if desired. Testing has shown that having the ability to produce those different spray patterns at any desirable timing in the engine cycle can allow for an overall reduction in undesirable emissions, which include NOx, unburned hydrocarbons and particulates. Thus, the fuel injection system of the present invention allows for different spray patterns that can be produced independently or simultaneously at any desired timing independent of engine speed and crank angle at a wide range of injection pressures that can be obtained through control of fuel pressure in the common fuel rail.

Figures 12A, 12B, 12C, 12D, 12E, 12F:
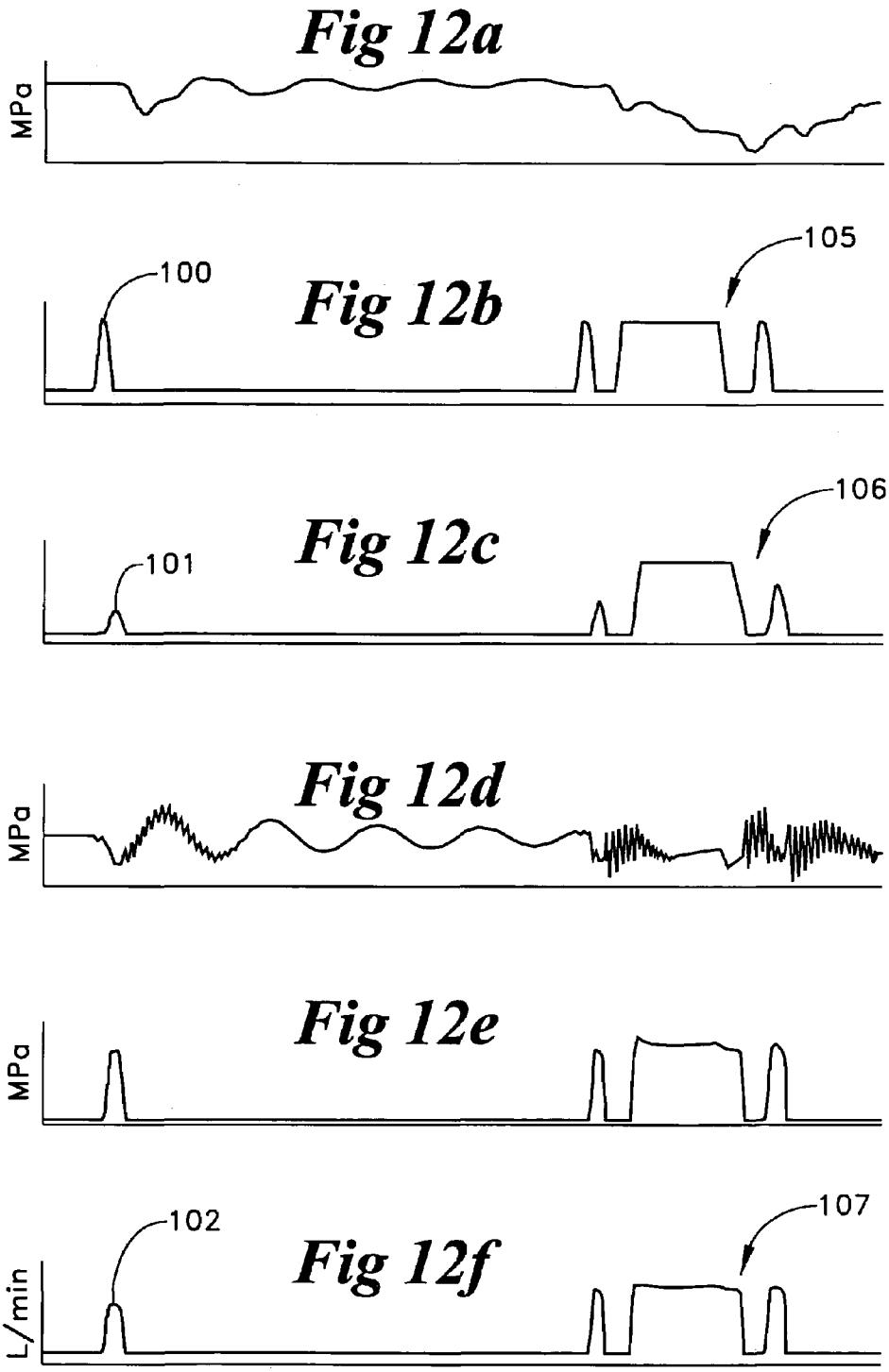
FIGS. 12A–F are graphs of rail pressure, control valve motion, needle valve member motion, nozzle supply pressure, sac pressure and injection rate versus time for an example injection sequence according to the present invention.

Referring to FIGS. 12A–F, various fuel injection system parameters are graphed against time for one mixed mode injection sequence that includes a single homogenous charge injection event 102 occurring early in the engine cycle, and three conventional injection events that make up a conventional injection sequence 107 that occurs later in the engine cycle. At some desired timing, the homogenous charge injection event 102 in initiated by energizing electrical actuator 64 to move needle control valve 28 to a position that fluidly connects pressure communication passage 42 to low pressure drain 46. This causes a pressure drop in outer needle control chamber 90, thus reducing the fluid pressure acting on closing hydraulic surface 92. By appropriately sizing closing hydraulic surface 92 relative to opening hydraulic surface 95 and by adjusting the flow restrictions as well as the desired fluid pressure, the outer needle valve member will be allowed to move upward toward its open position when electrical actuator 64 is energized. As stated earlier, outer needle valve member 91 moves upward but is hydraulically stopped due to an interaction between its closing hydraulic surface 92 and the location where pressure communication passage 42 opens into outer needle control chamber 90. The movement 100 of outer needle control valve 28 is shown in FIG. 12*b*, and the movement of outer needle valve member 91 in response is shown by the movement 101 in FIG. 12*c*. As shown, the first needle control valve 24 and the inner needle valve member 81 remain stationary during the homogenous charge injection event 102. FIG. 12*d* is of interest for showing that the sleeve pressure, or the pressure in nozzle supply passage 22, stays relatively close to that of the rail pressure the sac pressure is shown in FIG. 12*e*. The homogenous charge injection event 102, preferably takes place when the engine piston is closer to its bottom dead center position than its top dead center position in order to provide a substantial amount of time for thorough mixing between the fuel and the air in the cylinder. The homogenous charge injection event 102 is ended by de-energizing electrical actuator 64 so that pressure communication passage 42 is reconnected to high pressure communication passage 32. This causes high pressure to build in outer needle control chamber 90 and act on closing hydraulic surface 92, forcing outer needle valve member 91 downward toward its closed position as shown in FIG. 8.

As the engine piston continues its upward movement, the fuel from the homogenous charge injection event 102 continues to mix with air in the cylinder. At some desired timing when the engine piston is closer to its top dead center position than its bottom dead center position, the conventional injection sequence 107 can be initiated by energizing first electrical actuator 60 to move needle control valve 24 to a position that connects pressure communication passage 40 to low pressure drain 44. When this occurs, pressure in inner needle control chamber 80 drops allowing inner needle valve member 81 to lift upward to its open position to open conventional nozzle outlet set 84. Each injection event of the conventional injection sequence 107 involves energizing and de-energizing electrical actuator 60. In other words, first electrical actuator 60 is energized and de-energized three times to produce the injection sequence 107 shown in FIG. 12*f*. The movement of needle control valve 24 due to the energizing and de-energizing of first electrical actuator 60 is shown by the movement sequence 105 shown in FIG. 12*b*. Likewise, the movement of needle control valve 24 causes inner needle valve member 81 to move upward to its open position three times as shown in the movement sequence 106 of FIG. 12*c*. Each of the conventional injection events is ended by de-energizing electrical actuator 60 to cause needle control valve 24 to reconnect pressure communication passage 40 to high pressure passage 34. This causes high pressure to build in inner needle control chamber 80 causing the inner needle valve member 81 to move downward into contact with valve seat 83 to close conventional nozzle outlets 84.

Those skilled in the art will recognize that fuel injection system 10 and fuel injectors 14 can allow for a substantial reduction in undesirable emissions by allowing for two completely different spray patterns to be utilized at any desired timings. In addition, injection quantities can be relatively tightly controlled, and the minimum injection quantity can be relatively small, thus affording even more ability to match desired injection characteristics to a particular engine operating condition. Although the present invention has been illustrated as using hydraulic stops on both of the inner needle valve member 81 and outer needle valve member 91, those skilled in the art will appreciate that conventional physical stops could be utilized without departing from the intended scope of the present invention. For instance, this alternative could be accomplished by eliminating high pressure passages 36 and 38. In addition, although the present invention has been illustrated as using three way needle control valves 24 and 28, those skilled in the art will appreciate that the present invention could utilize two way needle control valves that would open and close the pressure communication passages 40 and 42 to a low pressure drain, respectively. In still another alternative embodiment it might be desirable to include an additional electronically controlled valve that would be positioned between the common fuel rail and the nozzle supply passages of the individual injectors. Such a control valve would allow the individual injectors to be placed in a low pressure condition between injection events. In addition, such a control valve could allow for both front and back end rate shaping by adjusting the relative timing of the opening of the fuel injector to the common rail relative to the activation of the individual needle control valves 24 and 28. For instance, it might be desirable to reduce fuel pressure in the injector toward the end of the injection event in order to possibly further reduce undesirable emissions by causing each injection event to end by allowing fuel pressure to drop below cylinder pressure before the individual needle valve member moves to its closed position. Thus, those skilled in the art will appreciate that a wide variety of variations could be made on the illustrated embodiment without departing from the intended scope of the present invention.

The above description is intended for illustrative purposes only, and is not intended to limit the scope of the present invention in any way. Thus, those skilled in the art will appreciate the other aspects, objects and advantages of this invention can be obtained from a study of the drawings, the disclosure and the appended claims.

What is claimed is:

1. A method injecting fuel, comprising the steps of:

injecting fuel in a first spray pattern at least in part by energizing one of a plurality of electrical actuators, relieving fuel pressure in a first needle control chamber and moving a first needle valve member in a direction with respect to a second needle valve member; and injecting fuel in a second spray pattern at least in part by energizing a different one of said plurality of electrical actuators, relieving fuel pressure in a second needle control chamber and moving a second needle valve member in said direction within and with respect to said first needle valve member.

2. The method of claim 1 wherein said direction is inward into the injector.

3. The method of claim 1 wherein one of said first injecting step and said second injecting step is performed when an engine piston is closer to a bottom dead center position than a top dead center position; and an other of said first injecting step and said second injecting step is performed when said engine piston is closer to a top dead center position than a bottom dead center position.

4. The method of claim 1 wherein said injecting steps are performed in the same engine cycle.

5. The method of claim 1 wherein said first spray pattern corresponds to a homogeneous charge spray pattern with a small average angle relative to a centerline; and said second spray pattern corresponds to a conventional spray pattern with a large average angle relative to said centerline.

6. The method of claim 1 wherein said first injecting step includes moving a first needle control valve member from contact with a first seat to contact with a second seat; and said second injecting step includes a moving a second needle control valve member from contact with a first seat to contact with a second seat.

7. The method of claim 1 wherein said first injecting step includes a step of closing a fluid connection between a nozzle supply passage and said first needle control chamber; and said second injecting step includes a step of closing a fluid connection between said nozzle supply passage and said second needle control chamber.

8. A fuel injector comprising:

an injector body defining a first nozzle outlet set and a second nozzle outlet set that correspond to a first spray pattern and a second spray pattern, respectively;

a first needle valve member at least partially positioned in said injector body and including a first opening hydraulic surface and a first closing hydraulic surface;

a second needle valve member at least partially positioned in said injector body and including a second opening hydraulic surface and a second closing hydraulic surface;

a first electrical actuator operably coupled to said first needle valve member via a first needle control chamber, and said first closing hydraulic surface being exposed to fluid pressure in said first needle control chamber;

a second electrical actuator operably coupled to said second needle valve member via a second needle control chamber, and said second closing hydraulic surface being exposed to fluid pressure in said second needle control chamber; and one of said first needle valve member and said second needle valve member being at least partially positioned in an other of said first needle valve member and said second needle valve member.

9. The fuel injector of claim 8 wherein said first electrical actuator is operably coupled to said first needle valve member via a first three way needle control valve; and said second electrical actuator is operably coupled to said second needle valve member via a second three way needle control valve.

10. The fuel injector of claim 9 wherein said first three way needle control valve closes a fluid connection between the first needle control chamber and a nozzle supply passage when in a first position; and said second three way needle control valve closes a fluid connection between the second needle control chamber and said nozzle supply passage when in a first position.

11. The fuel injector of claim 8 wherein said first spray pattern is a homogeneous charge spray pattern;

said second spray pattern is a conventional spray pattern; and said first nozzle outlet set surrounds said second nozzle outlet set about a centerline.

12. The fuel injector of claim 8 wherein one of said first nozzle outlet set and said second nozzle outlet set has a small average angle with respect to a centerline; and an other of said first nozzle outlet set and said second nozzle outlet set has a large average angle with respect to said centerline.

13. The fuel injector of claim 8 wherein said direction is inward into said injector body.

14. The fuel injector of claim 8 wherein said first needle valve member is moveable in a direction with respect to said second needle valve member to an open position; and said second needle valve member is moveable in said direction with respect to said first needle valve member to an open position.

15. A fuel injection system comprising:

a common fuel rail;

at least one fuel injector fluidly connected to said common fuel rail, and including an injector body defining a first nozzle outlet set and a second nozzle outlet set that correspond to a first spray pattern and a second spray pattern, respectively, and each fuel injector including a first needle valve member with a first opening hydraulic surface and a first closing hydraulic surface, and a second needle valve member with a second opening hydraulic surface and a second closing hydraulic surface;

a first electrical actuator operably coupled to open and close said first nozzle outlet set via the first closing hydraulic surface of the first needle valve member being exposed to fluid pressure in a first needle control chamber;

a second electrical actuator operably coupled to open and close said second nozzle outlet set via the second closing hydraulic surface of the second needle valve member being exposed to fluid pressure in a second needle control chamber; and one of said first needle valve member and said second needle valve member being at least partially positioned in an other of said first needle valve member and said second needle valve member.

16. The fuel injection system of claim 8 wherein said first electrical actuator is operably coupled to said first needle valve member via a first three way needle control valve; and said second electrical actuator is operably coupled to said second needle valve member via a second three way needle control valve.

17. The fuel injection system of claim 16 wherein said first three way needle control valve closes a fluid connection between the first needle control chamber and a nozzle supply passage when in a first position; and said second three way needle control valve closes a fluid connection between the second needle control chamber and said nozzle supply passage when in a first position.

18. The fuel injection system of claim 15 wherein one of said first nozzle outlet set and said second nozzle outlet set has a small average angle with respect to a centerline; and an other of said first nozzle outlet set and said second nozzle outlet set has a large average angle with respect to said centerline.

19. The fuel injection system of claim 15 wherein said direction is inward into said injector body.

20. The fuel injection system of claim 15 wherein said first needle valve member is moveable in a direction with respect to said second needle valve member to an open position; and said second needle valve member is moveable in said direction with respect to said first needle valve member to an open position.

* * * * *